US005165383A

United States Patent [19]

Ebert et al.

[11] Patent Number: 5,165,383

[45] Date of Patent: Nov. 24, 1992

[54] GUN WITH PIVOTING BARREL, PROJECTILE LOADER, AND TRIGGER INTERLOCK

[75] Inventors: Gary F. Ebert, Walworth; Keith L. Milliman, Fairport; Thomas Hughes, Canandaigua, all of N.Y.

[73] Assignee: Crosman Corporation, East Bloomfield, N.Y.

[21] Appl. No.: 634,082

[22] Filed: Dec. 26, 1990

[51] Int. Cl.[5] ..... F41B 11/06

[52] U.S. Cl. ..... 124/74; 124/76; 124/40; 124/51.1; 124/82; 42/44

[58] Field of Search ..... 124/73, 74, 76, 75, 124/71, 67, 52, 51.1, 40, 31, 82; 42/44, 36, 37, 40, 41, 42.01, 8; 89/160

[56] References Cited

U.S. PATENT DOCUMENTS

| | | | |
|---|---|---|---|
| 728,326 | 5/1903 | Sturgill . | |
| 2,150,288 | 3/1939 | Moller | 124/67 |
| 2,293,957 | 8/1942 | Wells . | |
| 2,364,232 | 12/1944 | Mills . | |
| 2,437,727 | 3/1948 | Drumheller . | |
| 2,569,995 | 10/1951 | Kapsa . | |
| 2,633,839 | 4/1953 | Lawrence | 124/67 |
| 2,830,568 | 4/1958 | Lohr . | |
| 3,000,371 | 9/1961 | Hyde | 124/74 X |
| 3,048,159 | 8/1962 | Kline . | |
| 3,084,833 | 4/1963 | Kline . | |
| 3,119,384 | 1/1964 | Merz | 124/51.1 X |
| 3,233,601 | 2/1966 | Walther . | |
| 3,379,188 | 4/1968 | Walther | 124/76 X |
| 3,548,802 | 12/1970 | Green . | |
| 3,824,981 | 7/1974 | Crane et al. | 124/53 X |
| 3,913,554 | 10/1975 | Pitcher | 124/67 |
| 4,156,980 | 6/1979 | Aspenwall . | |
| 4,164,929 | 8/1979 | Liepins . | |
| 4,489,515 | 12/1984 | Numbers . | |
| 4,602,608 | 7/1986 | Lacam . | |
| 4,774,929 | 10/1988 | Milliman . | |

*Primary Examiner*—Peter M. Cuomo

[57] ABSTRACT

A gun includes a frame and a pivoting barrel assembly which is releasably latched in a firing position by a pair of flexible and resilient latches on the barrel assembly which engage shoulders on the frame. A trigger is slidably mounted on the frame for movement between a rest position and a firing position. A projectile loader is mounted on the frame at the breech end of the barrel assembly for movement between a loading position and a firing position. The loader is provided with an opening which is aligned with a magazine in the frame when the loader is in the loading position and is aligned with the bore of the barrel assembly when the loader is in the firing position. A camming ramp on the trigger is engageable with the loader for moving the loader between the loading and firing positions as the trigger moves between the rest and firing positions. A trigger interlock is movably mounted on the frame and engages the trigger when the barrel assembly is out of the firing position for preventing the trigger from moving to the firing position. The trigger interlock is moved out of engagement with the trigger by the barrel assembly when the barrel assembly moves to the firing position.

23 Claims, 7 Drawing Sheets

FIG. 7
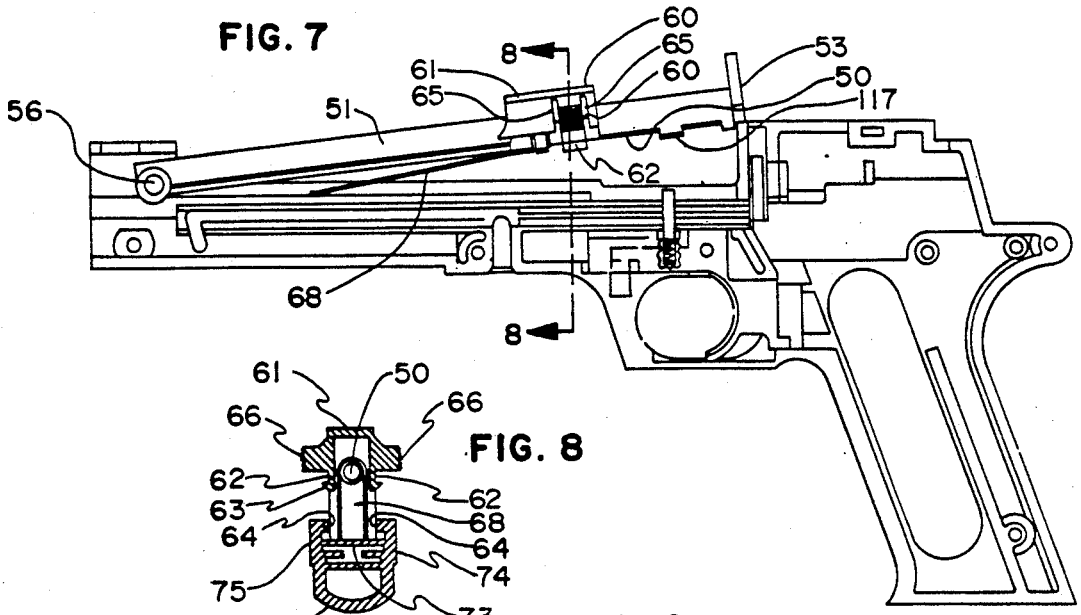
FIG. 8
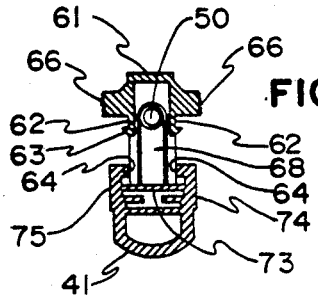
FIG. 9
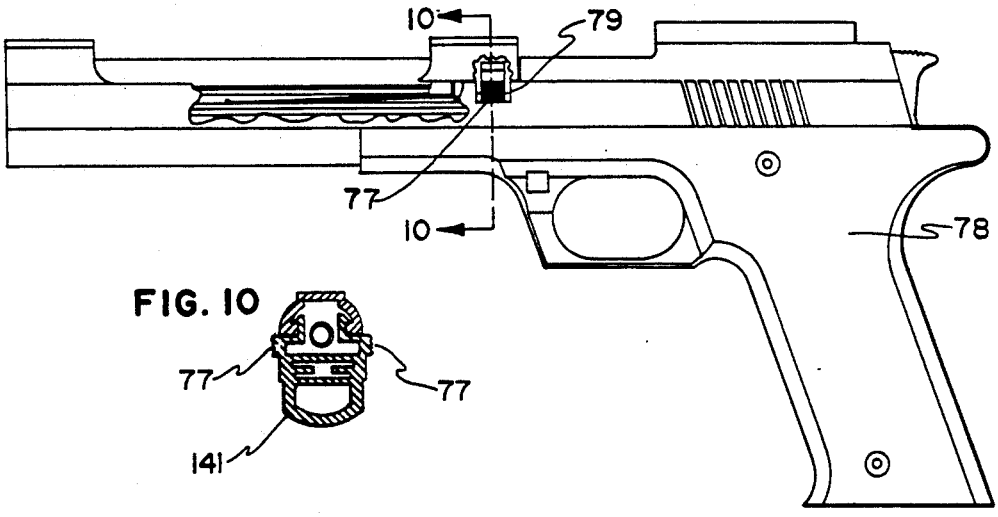
FIG. 10
FIG. 11
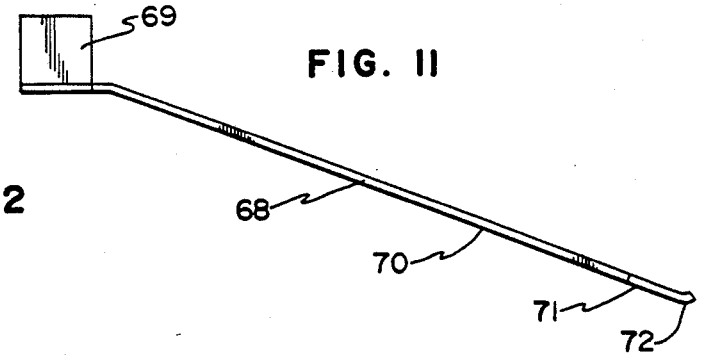
FIG. 12
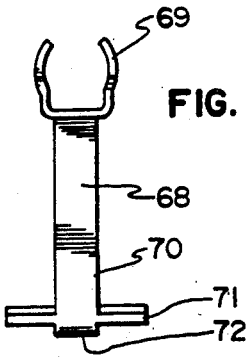

GUN WITH PIVOTING BARREL, PROJECTILE LOADER, AND TRIGGER INTERLOCK

BACKGROUND

This invention relates to guns, and, more particularly, to a gun which is equipped with a pivoting barrel, a projectile loader, and a trigger interlock for preventing the gun from being fired when the barrel is pivoted out of the firing position.

Guns have been provided with pivoting barrels in the past, For example, U.S. Pat. No. 4,774,929 describes an air gun which includes a pivoting barrel. A pivoting barrel permits checking the bore for ammunition, easy cleaning of the bore, and loading individual projectiles into the bore. However, if the barrel does not return to the exact location after each shot due to designed tolerances or wear, the accuracy of the gun will be erratic. Further, retention of the barrel in the firing position must be sufficient to withstand the forces encountered during firing without barrel movement for optimum accuracy.

U.S. Pat. No. 4,774,929 describes a pivoting lever for maintaining the barrel in the firing position. The firing position is controlled by a V block on the frame of the gun and a pad on the lever which engages the barrel and forces the barrel inside the V block.

SUMMARY OF THE INVENTION

The invention provides a gun with a pivoting barrel and a unique latch assembly for retaining and aligning the barrel in the firing position. The pivoting barrel engages a trigger interlock when the barrel is in the firing position which enables the trigger to be pulled. When the barrel pivots to the loading position, the trigger interlock engages the trigger and prevents the trigger from being pulled. A projectile loader is slidably mounted in the frame of the gun and cooperates with the trigger for moving a projectile from a magazine to a firing position which is aligned with the barrel. A cam ramp on the trigger engages the loader and moves the loader toward the firing position as the trigger is pulled. When the trigger is released, the loader returns to the loading position. A projectile pusher is slidably mounted in the magazine for pushing projectiles toward the loader. The loading end of the pusher is adapted to enter the loader when the magazine is empty and is provided with a camming surface for camming the pusher out of the loader when the loader moves out of the loading position.

DESCRIPTION OF THE DRAWING

The invention will be explained in conjunction with an illustrative embodiment shown in the accompanying drawing, in which

FIG. 7 is a view similar to FIG. 5 showing the barrel assembly in the loading position;

FIG. 8 is a sectional view taken along the line 8—8 of FIG. 7;

FIG. 9 is a side elevational view, partially broken away, showing an alternate embodiment of the latch for the barrel housing;

FIG. 10 is a sectional view taken along the line 10—10 of FIG. 9.

FIG. 11 is a side elevational view of the barrel spring;

FIG. 12 is a front elevational view of the barrel spring;

DESCRIPTION OF SPECIFIC EMBODIMENT

Figures 1, 2, 3, 4, 5, 6:
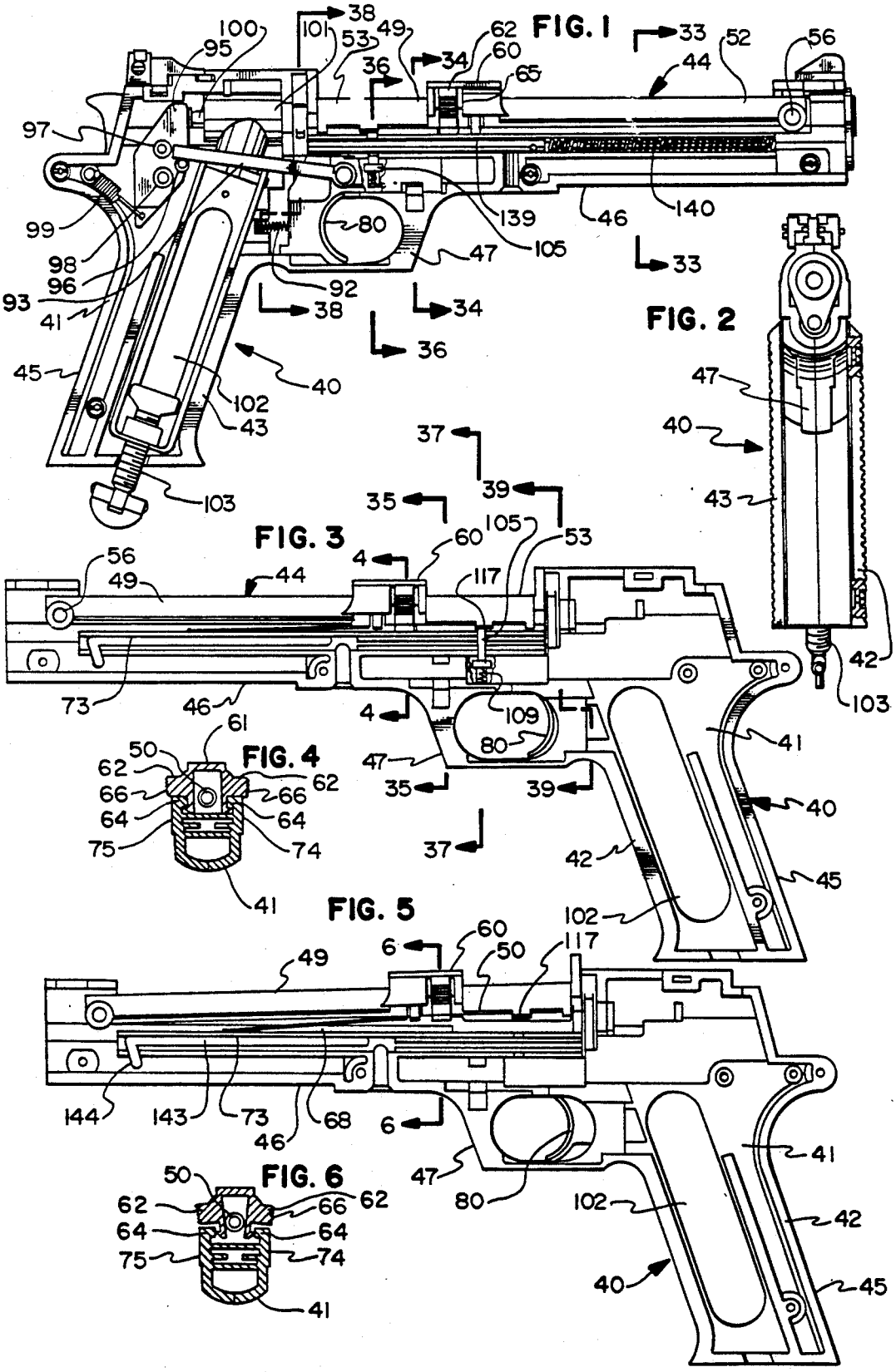
FIG. 1 is a side elevational view of a gun formed in accordance with the invention with the right half of the frame removed.
FIG. 2 is a front elevational view of the gun.
FIG. 3 is a left side elevational view of the gun with the left frame half removed.
FIG. 4 is a sectional view taken along the line 4—4.
FIG. 5 is a view similar to FIG. 3 showing the barrel assembly in the process of moving out of the firing position.
FIG. 6 is a sectional view taken along the line 6—6 of FIG. 5.

Referring to FIGS. 1–8, a pistol 40 includes a frame 41 which is provided by right and left frame halves 42 and 43 and a barrel assembly 44. The frame includes a grip portion 45, a barrel portion 46, and a trigger housing 47.

Pivoting Barrel Assembly

The barrel assembly 44 includes an elongated barrel housing 49 and an elongated cylindrical barrel 50 (FIGS. 6–8) which is mounted within the barrel housing. The barrel housing is advantageously molded from plastic such as Delrin, and the barrel is advantageously formed from metal. The barrel 50 is provided with a central bore through which a projectile is fired.

Figure 31:
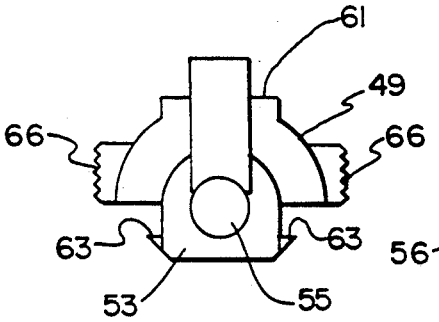
FIG. 31 is an end view of the breech end of the barrel housing.
Figure 32:
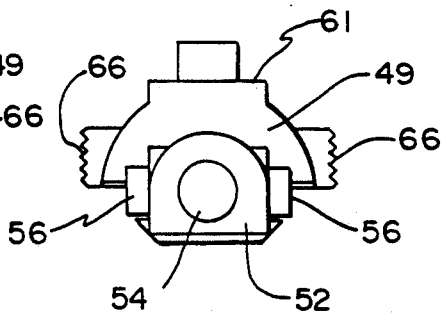
FIG. 32 is an end view of the muzzle end of the barrel housing.
Figure 33:
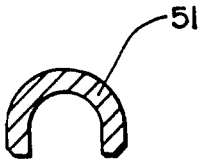
FIG. 33 is a sectional view of the barrel housing taken along the line 33—33 of FIG. 1.

The barrel housing includes a body portion 51 (FIGS. 7 and 33) which is generally U-shaped, a muzzle end portion 52 (see also FIG. 32), and a breech end portion 53 (FIG. 31). The muzzle and breech ends are provided with circular openings 54 and 55 (FIGS. 31 and 32) which support the barrel, and the body portion 51 covers the top of the barrel. The muzzle end includes a pair of pivot pins 56 which are pivotally supported in cylindrical recesses in the frame.

Barrel Latch Device

The barrel housing also includes a latch portion 60 which includes a flat top wall 61 and a pair of latches 62 which extend downwardly from the top wall. Each latch includes a laterally outwardly extending shoulder or ledge 63 which is engageable with a laterally inwardly extending shoulder or ledge 64 (FIG. 8) on the frame. The latches are separated from the remainder of the barrel housing by slots 65 (FIG. 7), and each latch is connected to the top wall 61 by an integral hinge portion so that the latch can flex relative to the barrel housing. Each latch includes an outwardly extending slotted finger portion 66 to facilitate flexing the latches inwardly toward each other.

Figure 34:
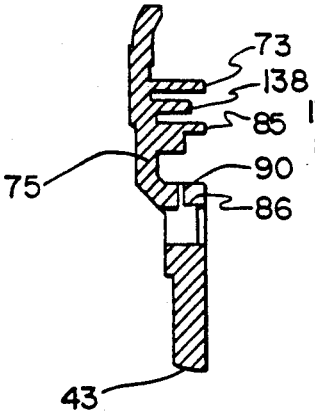
FIG. 34 is a sectional view of the left frame half taken along the line 34—34 of FIG. 1.
Figure 35:
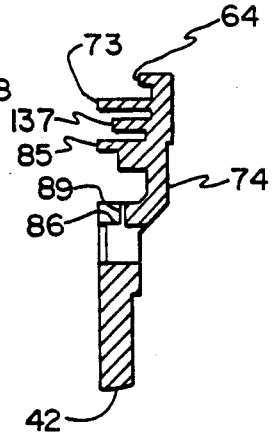
FIG. 35 is a sectional view of the right frame half taken along the line 35—35 of FIG. 3.
Figure 36:
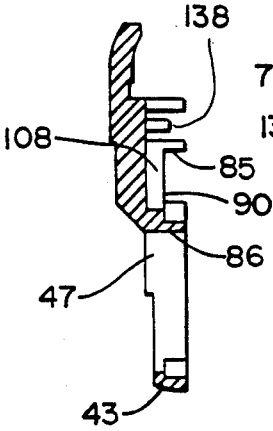
FIG. 36 is a sectional view of the left frame half taken along the line 36—36 of FIG. 1.
Figure 37:
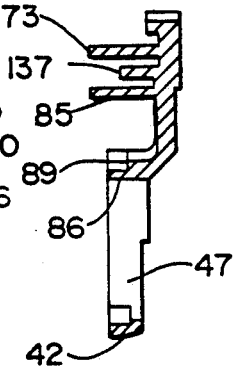
FIG. 37 is a sectional view of the right frame half taken along the line 37—37 of FIG. 3.

The barrel and barrel housing are resiliently biased to pivot upwardly by a barrel spring 68 (FIGS. 7, 11, and 12). The barrel spring includes a clamp portion 69 which is sized to snap over the barrel 50 and a base portion 70 which includes a pair of laterally outwardly extending end flanges 71 and which terminates in a curved bottom end 72. The bottom end of the spring engages flat walls 73 (FIGS. 8, 34, and 35) on the frame which extend laterally inwardly from the right and left side walls 74 and 75 of the right and left frame halves. The spring is centered within the frame by the flanges 71 which are confined by the side walls of the frame.

The barrel is maintained in a firing position illustrated in FIGS. 1–4 by the latches 62 which engage the shoulders 64 on the frame. The barrel is maintained in axial alignment within the frame by the engagement of the vertical surfaces of the latches with the vertical surfaces of the shoulders 64 as illustrated in FIG. 4.

When it is desired to pivot the barrel out of the firing position, the slotted finger portions 66 are pressed inwardly by the thumb and forefinger of one hand to release the latches 62 from the shoulders 64 as illustrated in FIG. 6. The barrel spring 68 then urges the barrel and barrel housing to pivot upwardly as shown in FIGS. 5 and 7. When the barrel pivots upwardly to a loading position in which the breech end of the barrel is above the frame, a projectile can be loaded into the breech end of the barrel.

The latches 62 are flexible and resilient, and the latches return to their unflexed position when the barrel housing pivots upwardly. The barrel can be returned to the firing position simply by pivoting the barrel housing downwardly. Camming surfaces on the bottom of the latches engage the top of the frame and force the latches inwardly as the barrel housing moves downwardly. When the shoulders 63 and the latches pass below the shoulders 64 in the frame, the latches snap into the latching position illustrated in FIG. 4.

An alternate embodiment of a barrel latching device is illustrated in FIGS. 9 and 10. Flexible latches 77 are provided on the frame 78 rather than on the barrel housing. The latches are separated from the remainder of the frame by slots 79. The latches include laterally outwardly extending shoulders which engage laterally inwardly extending shoulders on the barrel housing. The barrel housing is released from the firing position by pushing knurled portions on the latches inwardly.

Trigger

Figure 13:
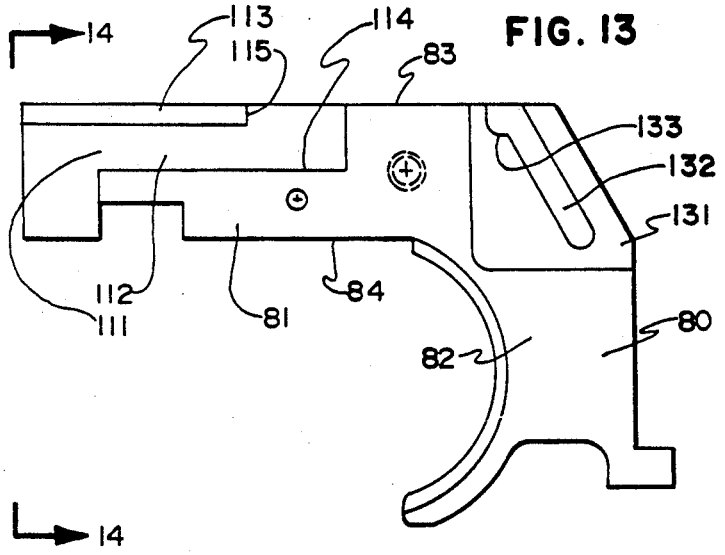
FIG. 13 is a side elevational view of the trigger.
Figure 14:
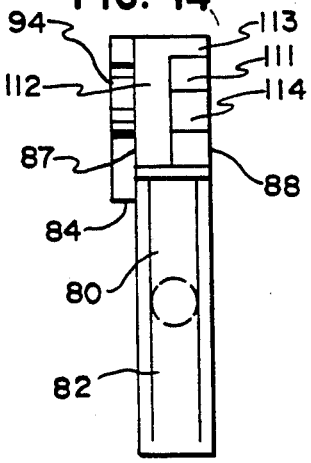
FIG. 14 is a front elevational view of the trigger taken along the line 14—14 of FIG. 13.
Figure 15:
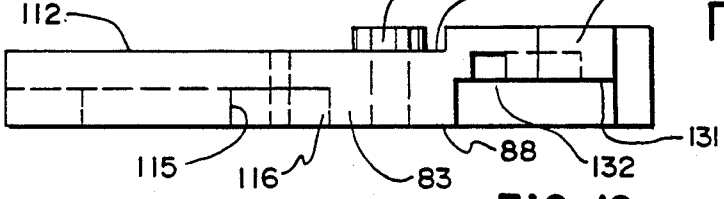
FIG. 15 is a top plan view of the trigger.
Figure 16:
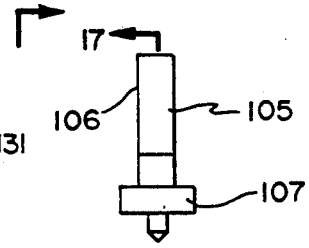
FIG. 16 is a side elevational view of the trigger interlock.
Figure 17:
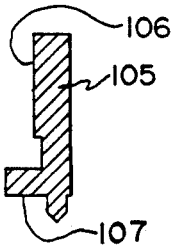
FIG. 17 is a sectional view taken along the line 17—17 of FIG. 16.
Figure 18:
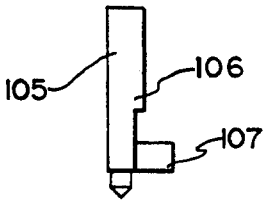
FIG. 18 is a front elevational view of the trigger interlock taken along the line 18—18 of FIG. 16.
Figure 19:
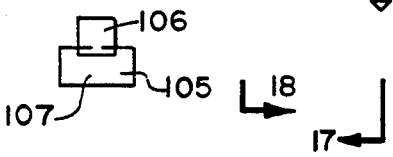
FIG. 19 is a top plan view of the trigger interlock.
Figure 20:
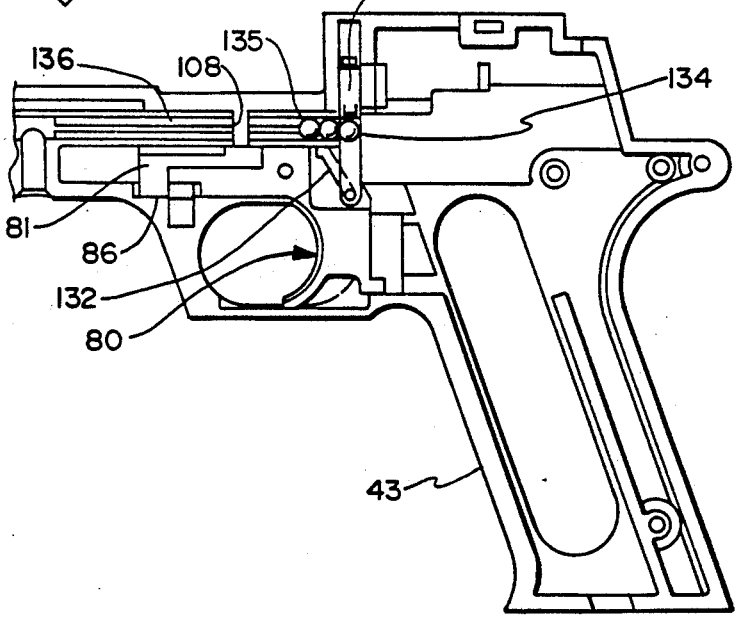
FIG. 20 is a fragmentary view of the gun showing the projectile loader in the loading position.
Figure 21:
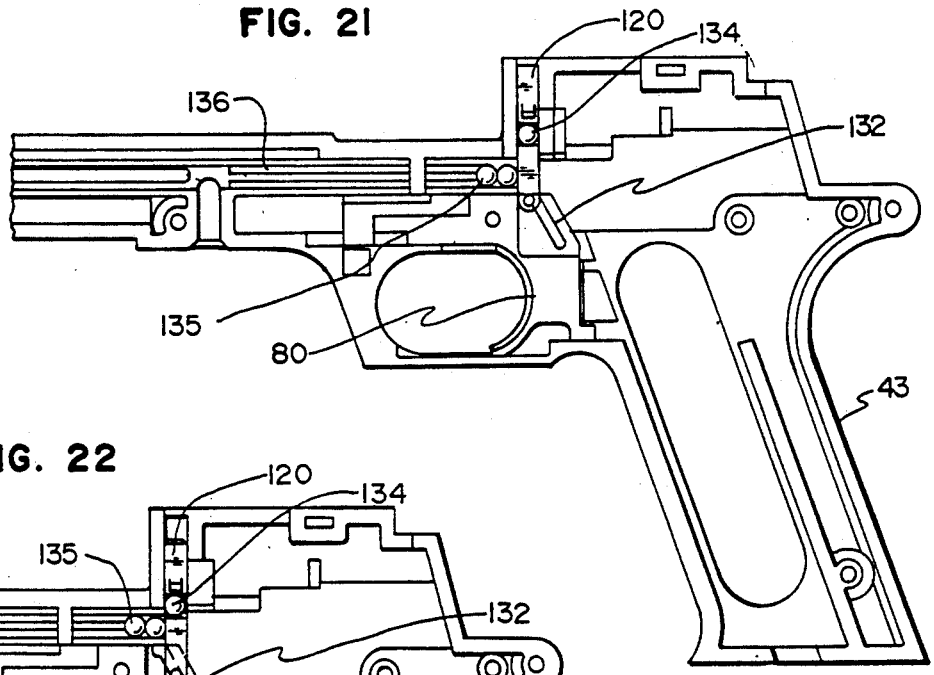
FIG. 21 is a view similar to FIG. 20 showing the projectile loader in the firing position.

A trigger 80 is slidably mounted on the frame for movement between a rest position illustrated in FIGS. 1 and 20 and a firing position illustrated in FIG. 21. Referring to FIGS. 13–15, the trigger includes a mounting portion 81 and a finger portion 82 which extends downwardly from the mounting portion. The mounting portion includes parallel flat top and bottom surfaces 83 and 84 which are slidably mounted between parallel flat walls 85 and 86 (FIGS. 34–37) on the right and left frame halves. Parallel side surfaces 87 and 88 on the mounting portion of the trigger slide between mating vertical surfaces 89 and 90 (FIGS. 34–37) on the right and left frame halves to maintain alignment of the trigger within the frame.

The trigger is resiliently biased to a forward or rest position illustrated in FIGS. 1 and 20 by a spring 92 (FIG. 1) which engages the trigger and the frame. A push rod 93 is pivotally connected to a cylindrical journal 94 (FIG. 15) on the trigger and extends rearwardly to a manner 95 (FIG. 1). The push rod 93 slides on a roller pin 96 and engages a hammer pin roller 97. The hammer is pivotally mounted on a pivot pin 98 which is mounted in the frame and is resiliently biased to rotate in a clockwise direction by a hammer spring 99. The hammer is engageable with a plunger 100 of a conventional gas valve assembly 101.

Pressurized $CO_2$ gas is supplied to the valve assembly by a $CO_2$ cartridge (not shown) which is mounted in a cartridge chamber 102 in the grip of the frame. A conventional piercing assembly 103 is mounted on the grip for piercing the seal on the end of the $CO_2$ cartridge.

As the trigger 80 is pulled rearwardly from its rest position illustrated in FIG. 1 to the firing position illustrated in FIG. 21, the push rod 93 pivots the hammer 95 counterclockwise against the force of the hammer spring 99. When the trigger approaches the firing position, the angle of the push rod 93 is such that continued rearward movement of the push rod will cause the push rod to ride over the hammer pin roller 97. The hammer will then be pivoted by the hammer spring against the plunger 100 of the valve assembly to release a charge of compressed gas within the valve assembly to fire a projectile such as a BB or pellet which is positioned in the barrel.

Although the particular embodiment of the gun illustrated is powered by compressed $CO_2$ gas, it will be understood that the inventive features described herein can be utilized in other types of guns, for example, air guns and firearms.

Trigger Interlock

The trigger is locked in its rest position when the barrel is pivoted out of its firing position by a trigger interlock 105 (FIGS. 1, 3, and 16–19). The trigger interlock includes a vertically extending body portion 106 which is generally rectangular in cross section and a locking tab or stop tab 107 which extends laterally from the body portion. The trigger interlock is slidably mounted in a vertically extending recess 108 (FIG. 36) in the left frame half 43 and is resiliently biased in an upward direction by a spring 109 (FIG. 3) which engages the frame and the bottom of the trigger interlock.

Referring to FIGS. 13–15, the mounting portion 81 of the trigger 80 is provided with a channel 11 which is defined by a side wall 112 and top and bottom walls 113 and 114. The top wall 113 includes a rear end or shoulder 115 which provided a top opening 116 (FIG. 15) into the channel 111. The top opening of the trigger channel 111 is sized to permit the locking tab 107 of the trigger interlock 105 to move vertically through the opening.

The body portion 106 of the trigger interlock is slidably mounted on the left side of the trigger, and the top end of the trigger interlock is engageable by a projection 117 (FIG. 3) which extends downwardly from the U-shaped barrel housing 49. When the barrel is pivoted upwardly out of the firing position, the interlock spring 109 moves the trigger interlock upwardly until the locking tab 107 enters the top opening 116 in the trigger channel 111. In that position the rear end 115 of the top wall 113 of the trigger is engageable with the locking tab 107 of the trigger interlock, and the trigger cannot be pulled rearwardly from its rest position.

When the barrel is in the firing position, the trigger interlock will be pushed downwardly by the projection 117 on the barrel housing to position the locking tab 107 of the trigger interlock within the channel 111 in the trigger. The trigger may then be pulled toward the firing position. As the trigger moves rearwardly, the channel 111 slides over the locking tab 107 of the trigger interlock.

Projectile Loader

Figure 38:
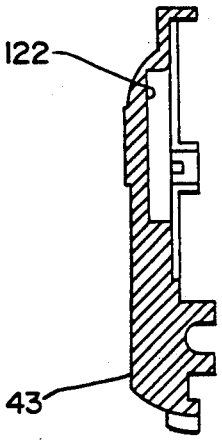
FIG. 38 is a sectional view of the left frame half taken along the line 38—38 of FIG. 1.
Figure 39:
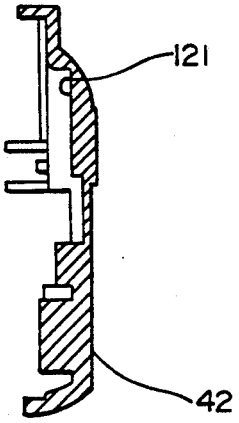
FIG. 39 is a sectional view of the right frame half taken along the line 39—39 of FIG. 3.

Referring to FIGS. 20–22 and 26–28, a projectile loader 120 is slidably mounted in vertically extending recesses 121 and 122 (FIGS. 38 and 39) in the right and left frame halves 42 and 43. The projectile loader includes a generally flat body having a generally rectangular top portion 123 and a generally rectangular bottom portion 124 which has a shorter width than the top portion. A projectile-receiving opening 125 extends through the top portion 123 of the body. Guide tabs 126 and 127 extend laterally outwardly from the top portion 123 and ride within the recesses 121 and 122 in the frame. A cam pin 130 extends laterally from the bottom portion 124 of the projectile loader.

Referring to FIGS. 13–15, the side wall 88 of the rear portion of the mounting portion 81 of the trigger 80 is recessed inwardly at 131, and an upwardly and forwardly inclined camming ramp or track 132 is formed in the recessed side wall 131. The front surface of the camming ramp 132 extends forwardly at 133 at the top of the camming ramp.

The reduced-width bottom portion 124 of the projectile loader extends alongside the recessed side wall 131 of the trigger, and the cam pin 130 on the projectile loader extends into the camming ramp 132. When the trigger is in the rest position illustrated in FIG. 20, the cam pin 130 is positioned at the bottom of the camming ramp, and the projectile loader is maintained in a loading position. A BB 134 is positioned in the projectile-receiving opening 125 of the loader.

Figure 22:
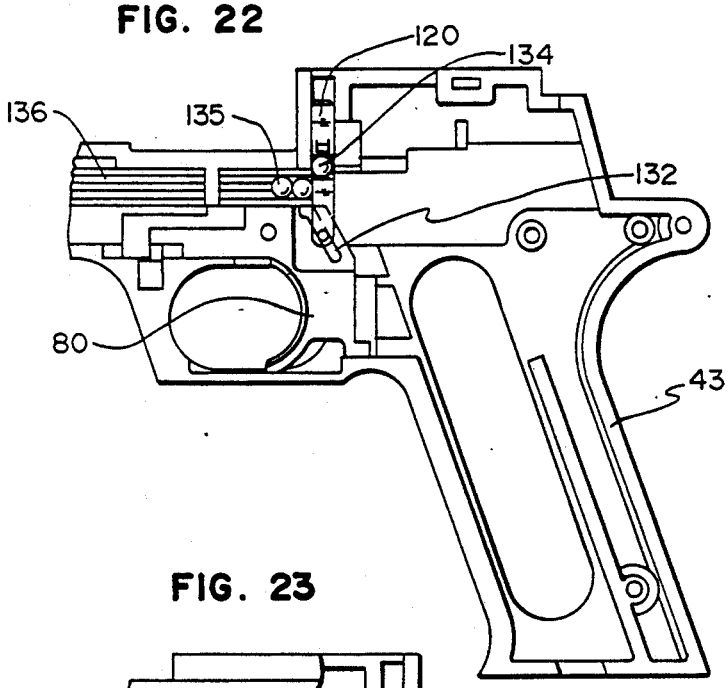
FIG. 22 is a view similar to FIGS. 20 and 21 showing the projectile loader intermediate the loading and firing positions.

As the trigger is pulled rearwardly, the camming ramp forces the cam pin 130 and the projectile loader upwardly as shown in FIG. 22. When the trigger reaches the firing position illustrated in FIG. 21, the projectile loader 120 is also in a firing position in which the projectile-receiving opening 125 is aligned with the bore of the barrel. Further rearward travel of the trigger to release the hammer without raising the projectile loader is permitted by the forwardly extending portion 133 of the camming ramp. Compressed gas which is released from the valve assembly 101 (FIG. 1) when the hammer strikes the plunger 100 forces the BB 134 through the barrel.

When the trigger is released, the trigger spring 92 pushes the trigger forwardly, and the cam ramp 132 returns the projectile loader to the loading position illustrated in FIG. 20.

Projectile Pusher

The BB's 135 which are illustrated in FIGS. 20–22 are positioned in a magazine 136 in the frame. Referring to FIGS. 34–37, the magazine is provided by the space between horizontal top and bottom walls 73 and 85 of the right and left frame halves. Ribs 137 and 138 on the right and left frame halves extend between the top and bottom walls for centering the BB's within the magazine.

Figure 29:
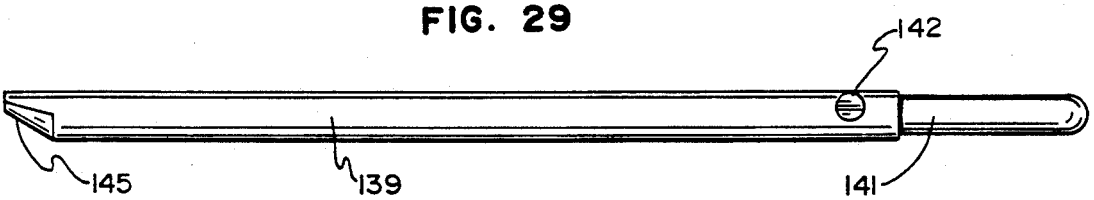
FIG. 29 is a side elevational view of the projectile pusher.
Figure 30:
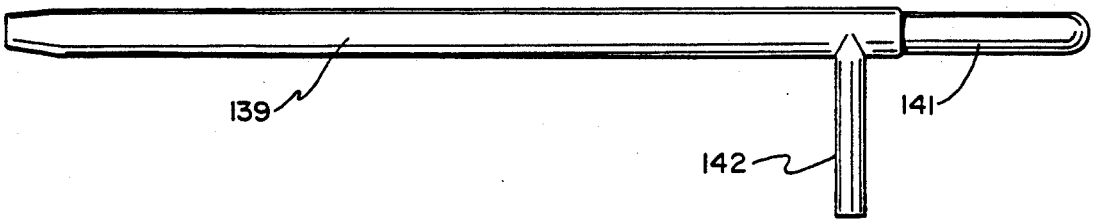
FIG. 30 is a top plan view of the projectile pusher.

An elongated pusher rod 139 (FIGS. 1, 29, and 30) is slidably mounted in the magazine and is resiliently biased rearwardly by a spring 140 (FIG. 1). The pusher rod is generally cylindrical and includes a reduced-diameter forward end portion 141 which engages the spring 140. A pin 142 extends transversely outwardly from the pusher rod through a slot 143 (FIGS. 5 and 23–25) in the right frame half 42. The forward end of the slot 143 extends downwardly at 144, and the pusher rod 139 can be latched in a forward position against the bias of the spring 140 by positioning the pin 142 in the downwardly extending slot 14. The rear end of the pusher rod is provided with a camming surface 145 which extends upwardly at an actuate angle with respect to the axis of the pusher rod.

Figure 23:
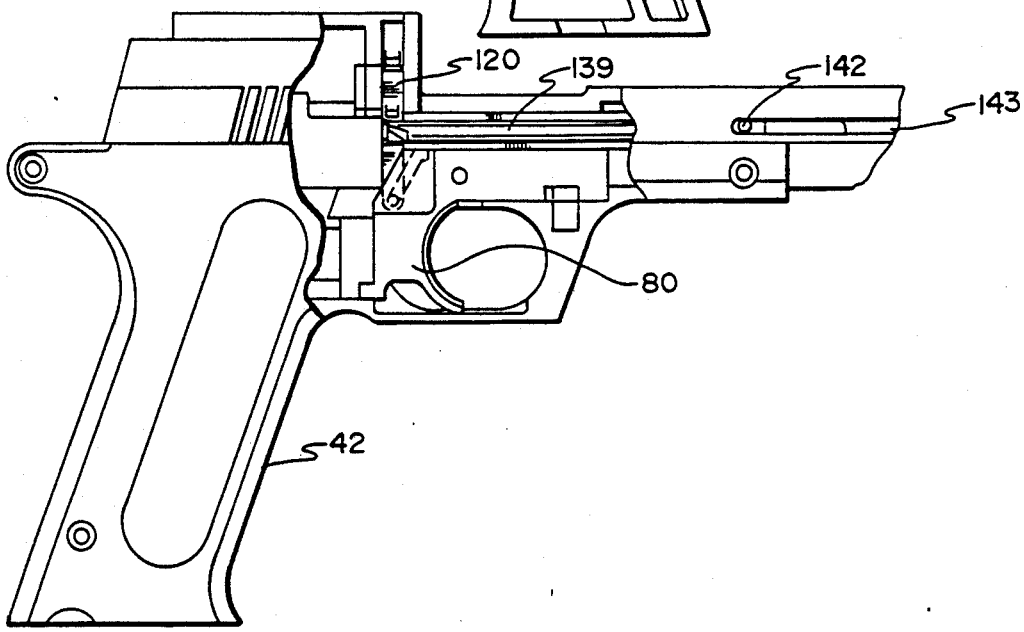
FIG. 23 is a fragmentary view of the gun showing the loader in the loading position and the projectile pusher extending into the loader.
Figure 24:
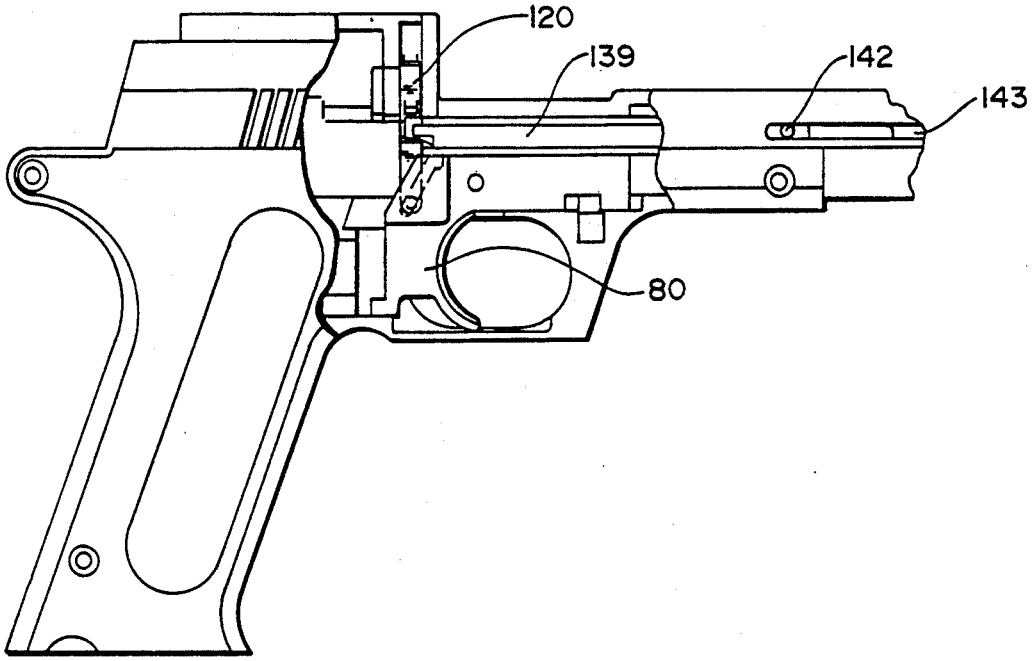
FIG. 24 is a view similar to FIG. 23 showing the projectile loader moving upwardly and camming the projectile pusher out of the loader.
Figure 25:
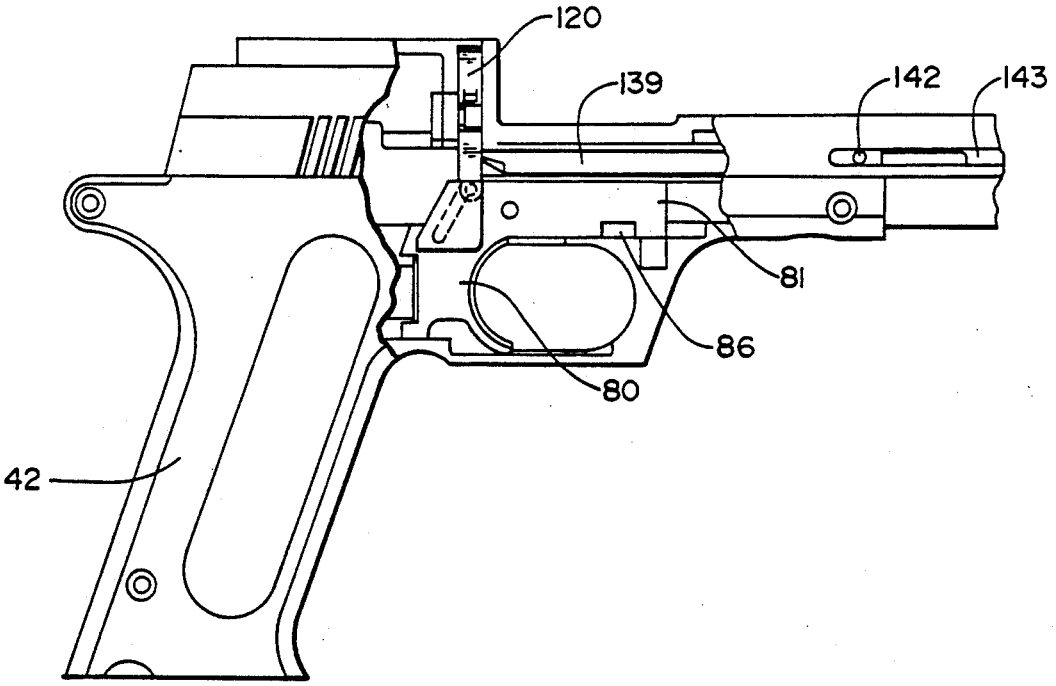
FIG. 25 is a view similar to FIG. 24 showing the loader in the firing position.
Figure 26:
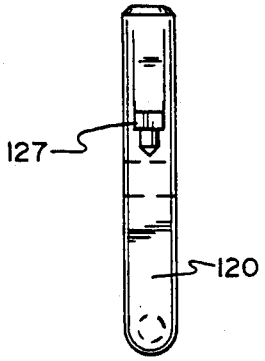
FIG. 26 is a left side elevational view of the projectile loader.
Figure 27:
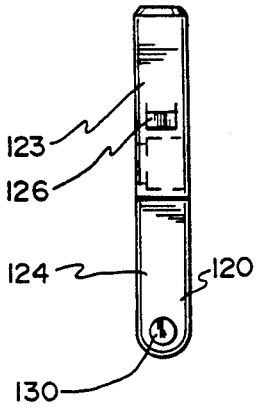
FIG. 27 is a right side elevational view of the projectile loader.
Figure 28:
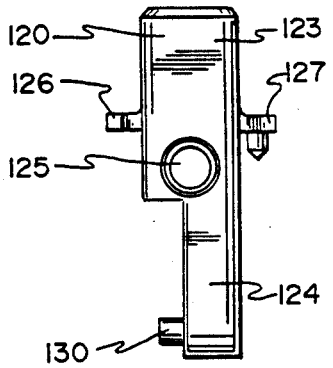
FIG. 28 is a front elevational view of the projectile loader.

The resiliently biased pusher rod forces the BB's in the magazine toward the projectile loader, and when the projectile loader returns to its loading position, the rearmost BB will be forced into the projectile-receiving opening 125. When the magazine is empty, the rear end of the pusher rod will enter the projectile-receiving opening as shown in FIG. 23. Even though the pusher rod enters the opening in the loader, the gun can still be fired by virtue of the camming surface 145 on the end of the pusher rod. As the trigger is pulled, the edge of the projectile-receiving opening in the loader engages the camming surface 145 on the pusher rod as illustrated in FIG. 24 and forces the pusher rod forwardly away from the loader. FIG. 25 illustrates the pusher rod being cammed completely out of the projectile-receiving opening to permit the loader to be raised to the firing position.

The cam disengagement of the pusher rod permits the pistol to be test fired or fired with a single shot when the magazine is empty. The pistol can be fired with a single shot by pivoting the barrel to the loading position, loading a pellet into the breech end of the barrel, returning the barrel to the firing position, and pulling the trigger.

While in the foregoing specification a detailed description of a specific embodiment of the invention was set forth for the purpose of illustration, it will be understood that many of the details herein given may be varied considerably by those skilled in the art without departing from the spirit and scope of the invention.

We claim:

1. A gun comprising:

a frame, a barrel assembly comprising a barrel housing and a barrel fixed on the barrel housing for movement with the barrel housing, the barrel assembly having a muzzle end and a breech end and being pivotally mounted on the frame adjacent the muzzle end for movement between firing and loading positions, and mean son the muzzle end of the barrel housing and on the breech end of the barrel housing for fixing the barrel to the barrel housing whereby the barrel and barrel housing pivot together, latching means on the barrel assembly and on the frame which are releasably engageable for maintaining the barrel assembly in the firing position, said latching means comprising a pair of latches which are flexibly mounted on one of the barrel assembly and the frame on opposite sides of the barrel and a pair of latch-engaging shoulders which are mounted on the other of the barrel assembly and the frame on opposite sides of the barrel, and release means for disengaging the latching means whereby the barrel assembly can move from the firing position to the loading position.

2. The gun of claim 1 including a spring engaging the barrel assembly and the frame for resiliently biasing the barrel assembly toward the loading position.

3. The gun of claim 1 which said pair of latches are flexibly mounted on the barrel housing on opposite sides of the barrel and said pair of latch-engaging shoulders are mounted on the frame, said release means comprising finger portion is on the latches for flexing the latches together whereby the latches may be disengaged from the shoulders.

4. The gun of claim 3 in which said barrel housing and said latches are integrally formed of plastic, each of the latches being attached to the remainder of the barrel housing along a hinge portion which permits the latch to flex relative to the remainder of the barrel housing.

5. The gun of claim 4 in which each of the latches includes a shoulder portion which extends transversely outwardly from the barrel and which is engageable with one of the latch-engaging shoulders on the frame.

6. The gun of claim 5 including a spring engaging the barrel assembly and the frame for resiliently biasing the barrel assembly toward the loading position and for forcing the shoulder portions of the latches against the latch-engaging shoulders when the barrel assembly is in the firing position.

7. The gun of claim 3 in which the latches and the latch-engaging shoulders include aligning surfaces which extend transversely to the shoulders and which are engageable for aligning the barrel assembly relative to the frame.

8. The gun of claim 1 in which said pair of latches are flexibly mounted on the frame on opposite sides of the barrel and said pair of latch-engaging shoulders are mounted on the barrel housing, said releasing means comprising finger portions on the latches for flexing the latches together whereby the latches may be disengaged from the shoulders.

9. The gun of claim 1 in which said means on the muzzle end of the barrel housing and on the breech end of the barrel housing is provided by an opening in the muzzle end and an opening in the breech end through which the barrel extends.

10. A gun comprising:

a frame, an elongated barrel assembly having a muzzle end and a breech end and being pivotally mounted on the frame adjacent the muzzle end for movement between firing and loading positions, a trigger mounted on the frame for movement between a rest position and a firing position, and a trigger interlock slidably mounted in the frame for movement generally transversely to the axis of the barrel assembly, the trigger interlock being engageable by the barrel assembly and being movable from a locking position to an unlocking position as the barrel assembly moves to the firing position, a spring engaging the frame and the trigger interlock for resiliently biasing the trigger interlock to the locking position whereby the trigger interlock is maintained in the locking position when the barrel assembly is in the loading position, the trigger interlock being engageable with the trigger when the trigger interlock is in the locking position to prevent the trigger from moving to the firing position and being disengaged from the trigger when the trigger interlock is in the unlocking position whereby the trigger may be moved to the firing position.

11. The gun of claim 10 in which the trigger interlock includes an elongated body and a stop portion which extends outwardly from the body, the elongated body being slidably mounted in the frame for movement in a direction transverse to the sliding movement of the trigger, the trigger including a shoulder which is engageable with the stop portion when the trigger interlock is in the locking position.

12. The gun of claim 11 in which the trigger includes a mounting portion which is slidably mounted in the frame and a finger portion which extends downwardly from the mounting portion, said shoulder being attached to the mounting portion and extending generally transversely to the the sliding movement of the trigger.

13. A gun comprising:

a frame having a projectile magazine, an elongated barrel mounted on the frame and having an axially extending bore for firing a projectile, a trigger slidably mounted on the frame for longitudinal sliding movement generally parallel to the axis of the barrel between a rest position and a firing position, a projectile loader slidably mounted in the frame for transverse sliding movement perpendicular to the axis of the barrel, the projectile loader having a projectile-receiving opening and being slidable between a loading position in which the projectile-receiving opening is aligned with the magazine and a firing position in which the projectile-receiving opening is aligned with the bore of the barrel, and cam means connecting the trigger and the projectile loader for translating the longitudinal movement of the trigger into transverse movement of the projectile loader for moving the projectile loader between the loading and firing positions as the trigger moves between the rest and firing position, said cam means including a camming ramp on the trigger which extends at an acute angle with respect to the axis of the barrel and the pin on the projectile loader which engages the camming ramp.

14. The gun of claim 13 in which the barrel includes a forward muzzle end and a rear breech end, the projectile loader being mounted behind the breech end, the trigger being mounted below the barrel and the camming ramp extending upwardly and forwardly.

15. The gun of claim 14 in which the camming ramp on the trigger includes a forwardly extending upper end portion which permits the trigger to move rearwardly to fire the gun without moving the projectile loader.

16. The gun of claim 13 including a projectile pusher slidably mounted in the magazine and spring means for resiliently biasing the projectile pusher toward the projectile loader.

17. The gun of claim 16 in which the projectile pusher includes an end portion which is adapted to enter the projectile-receiving opening in the projectile loader when the magazine is empty, the end portion of the projectile pusher having a camming surface which is engageable with the projectile loader whereby the projectile pusher is cammed out of the projectile-receiving opening when the projectile loader moves out of the loading position.

18. The gun of claim 17 in which the projectile pusher includes an elongated body which extends parallel to the axis of the barrel and the camming surface on the projectile pusher extends at an angle to the axis of the body.

19. A gun comprising:

a frame having a projectile magazine, an elongated barrel assembly comprising a barrel housing and a barrel fixed on the barrel housing for movement with the barrel housing, the barrel assembly having a forward muzzle end and a rear breech end and being pivotally mounted on the frame adjacent the muzzle end for movement between firing and loading positions, the barrel assembly having an axially extending bore, latching means on the barrel assembly and on the frame which are releasably engageable to maintain the barrel assembly in the firing position, release means for disengaging the latching means whereby the barrel assembly can move from the firing position to the loading position, a trigger slidably mounted on the frame for longitudinal sliding movement generally parallel to the axis of the barrel between a rest position and a firing position, a projectile loader slidably mounted on the frame for transverse sliding movement perpendicular to the axis of the bore, the projectile loader having a projectile-receiving opening and being slidable between a loading position in which the projectile-receiving opening is aligned with the magazine and a firing position in which the projectile-receiving opening is aligned with the bore of the barrel, and cam means connecting the trigger and the projectile loader for translating the longitudinal movement of the trigger into transverse movement of the projectile loader for moving the projectile loader between the loading and firing positions as the trigger moves between the rest and firing positions, said cam means including a camming ramp on the trigger which extend at an acute angle with respect to the axis of the barrel and a pin on the projectile loader which engages the camming ramp.

20. The gun of claim 19 including a projectile pusher slidably mounted in the magazine and spring means for resiliently biasing the projectile pusher toward the projectile loader.

21. A gun comprising:

a frame having a projectile magazine, an elongated barrel assembly comprising a barrel housing and a barrel fixed on the barrel housing for movement with the barrel housing, the barrel assembly having a forward muzzle end and a rear breech end and being pivotally mounted on the frame adjacent the muzzle end for movement between firing and loading positions, the barrel assembly having an axially extending bore, latching means on the barrel assembly and on the frame which are releasably engageable to maintain the barrel assembly in the firing position, release means for disengaging the latching means whereby the barrel assembly can move from the firing position to the loading position, a trigger slidably mounted on the frame for longitudinal sliding movement generally parallel to the axis of the barrel between a rest position and a firing position, a projectile loader slidably mounted on the frame for transverse sliding movement perpendicular to the axis of the bore, the projectile loader having a projectile-receiving opening and being slidable between a loading position in which the projectile-receiving opening is aligned with the magazine and a firing position in which the projectile-receiving opening is aligned with the bore of the barrel, cam means connecting the trigger and the projectile loader for translating the longitudinal movement of the trigger into the transverse movement of the projectile loader for moving the projectile loader between the loading and firing positions as the trigger moves between the rest and firing positions, and a trigger interlock slidably mounted on the frame for movement generally transverse to the axis of the barrel assembly, the trigger interlock being engageable by the barrel assembly and being movable from a locking position to an unlocking position as the barrel moves to the firing position, the trigger interlock being engageable with the trigger when the trigger interlock is in the locking position to prevent the trigger from moving to the firing position and being disengaged from the trigger when the trigger interlock is in the unlocking position whereby the trigger may be moved to the firing position.

22. A gun comprising:

a frame having a projectile magazine, an elongated barrel assembly comprising a barrel housing and a barrel fixed on the barrel housing for movement with the barrel housing, the barrel assembly having a forward muzzle end and a rear breech end and being pivotally mounted on the frame adjacent the muzzle end for movement between firing and loading positions, the barrel assembly having an axially extending bore, latching means on the barrel assembly and on the frame which are releasably engageable to maintain the barrel assembly in the firing position, release means for disengaging the latching means whereby the barrel assembly can move from the firing position to the loading position, a trigger slidably mounted on the frame for longitudinal sliding movement generally parallel to the axis of the barrel between a rest position and a firing position, a projectile loader slidably mounted on the frame for transverse sliding movement perpendicular to the axis of the bore, the projectile loader having a projectile-receiving opening and being slidable between a loading position in which the projectile-receiving opening is aligned with the magazine and a firing position in which the projectile-receiving opening is aligned with the bore of the barrel, cam means connecting the trigger and the projectile loader for translating the longitudinal movement of the trigger into transverse movement of the projectile loader for moving the projectile loader between the loading and firing positions as the trigger moves between the rest and firing positions, and the latching means comprising a pair of latches which are flexibly mounted on the barrel housing on opposite sides of the barrel and a pair of latch-engaging shoulders on the frame, said release means comprising finger portions on the latches for flexing the latches together whereby the latches may be disengaged from the shoulders.

23. The gun of claim 22 in which said barrel housing and said latches are integrally formed of plastic, each of the latches being attached to the remainder of the barrel housing along a hinge portion which permits the latch to flex relative to the remainder of the barrel.

* * * * *

UNITED STATES PATENT AND TRADEMARK OFFICE

CERTIFICATE OF CORRECTION

PATENT NO. : 5,165,383

DATED : November 24, 1992

INVENTOR(S) : Gary F. Ebert et al

It is certified that error appears in the above-identified patent and that said Letters Patent is hereby corrected as shown below:

Col. 7, line 20 change "mean" to --means-- and change "son" to --on--; line 43 change "portion" to --portions-- and delete "is".

Col. 10, line 2 change "extend" to --extends--.

Signed and Sealed this

Fifth Day of October, 1993

*Attest:*

*Attesting Officer*

Bruce Lehman

BRUCE LEHMAN

*Commissioner of Patents and Trademarks*